US007153200B1

(12) United States Patent
Wu

(10) Patent No.: US 7,153,200 B1
(45) Date of Patent: Dec. 26, 2006

(54) BLADE GRINDING TOOL

(75) Inventor: Shih-Piao Wu, Changhua Hsien (TW)

(73) Assignee: Jiin Haur Industrial Co., Ltd., Lu Kang (TW)

( * ) Notice: Subject to any disclaimer, the term of this patent is extended or adjusted under 35 U.S.C. 154(b) by 0 days.

(21) Appl. No.: 11/231,074

(22) Filed: Sep. 20, 2005

(51) Int. Cl.
*B24B 3/36* (2006.01)

(52) U.S. Cl. ..... 451/344; 451/442; 451/556

(58) Field of Classification Search ..... 451/344, 451/349, 67, 442, 555, 556, 917
See application file for complete search history.

(56) References Cited

U.S. PATENT DOCUMENTS 3,675,886 A * 7/1972 Kampmier ..... 248/363
3,680,264 A * 8/1972 Dewitt ..... 451/293
4,388,780 A * 6/1983 Rees ..... 451/282
5,245,789 A * 9/1993 Rees et al. ..... 451/198
6,457,498 B1 * 10/2002 Salus et al. ..... 144/28.1
6,470,929 B1 * 10/2002 Fregeolle ..... 144/28.72

* cited by examiner

*Primary Examiner*—Jacob K. Ackun, Jr.
(74) *Attorney, Agent, or Firm*—Alan D. Kamrath; Nikolai & Mersereau, P.A.

(57) ABSTRACT

A blade grinding tool includes a main base, a sucker mounted on the main base and attached to a surface, and a grinding unit mounted on the main base for grinding a blade of a cutting tool. Thus, the blade grinding tool is attached to a surface, so that a user needs not to hold the blade grinding tool by his one hand when grinding the blade of the cutting tool by the grinding unit, thereby facilitating the user grinding the blade of the cutting tool, and thereby protecting the user's safety.

6 Claims, 5 Drawing Sheets

BLADE GRINDING TOOL

BACKGROUND OF THE INVENTION

1. Field of the Invention

The present invention relates to a blade grinding tool, and more particularly to a blade grinding tool for grinding a blade of a cutting tool, such as a knife or the like.

2. Description of the Related Art

A conventional grindstone is used to grind a blade of a cutting tool when the blade is worn or rusted. However, the grinding angle between the blade of the cutting tool and the grindstone cannot be controlled easily, thereby causing inconvenience to a user when grinding the blade of the cutting tool, and thereby decreasing the grinding effect of the grindstone.

A conventional blade grinding tool comprises a support seat, and a grindstone mounted on the support seat to grind the blade of the cutting tool. However, the user has, to hold the support seat by his one hand when grinding the blade of the cutting tool by the grindstone, thereby causing inconvenience to the user when grinding the blade of the cutting tool, and thereby easily causing danger to the user.

SUMMARY OF THE INVENTION

In accordance with the present invention, there is provided a blade grinding tool, comprising a main base, a sucker mounted on the main base and attached to a surface, and a grinding unit mounted on the main base for grinding a blade of a cutting tool.

The primary objective of the present invention is to provide a blade grinding tool for grinding and finishing a blade of a cutting tool, such as a knife or the like.

Another objective of the present invention is to provide a blade grinding tool, wherein the blade grinding tool is attached to a surface, so that a user needs not to hold the blade grinding tool by his one hand when grinding the blade of the cutting tool by the grinding unit, thereby facilitating the user grinding the blade of the cutting tool, and thereby protecting the user's safety.

A further objective of the present invention is to provide a blade grinding tool, wherein the blade grinding tool is attached to a horizontal surface and a vertical surface so that the blade grinding tool is operated and stored easily, thereby facilitating the user operating the blade grinding tool, and thereby saving the space of storage of the blade grinding tool.

Further benefits and advantages of the present invention will become apparent after a careful reading of the detailed description with appropriate reference to the accompanying drawings.

DETAILED DESCRIPTION OF THE INVENTION

Figure 1:
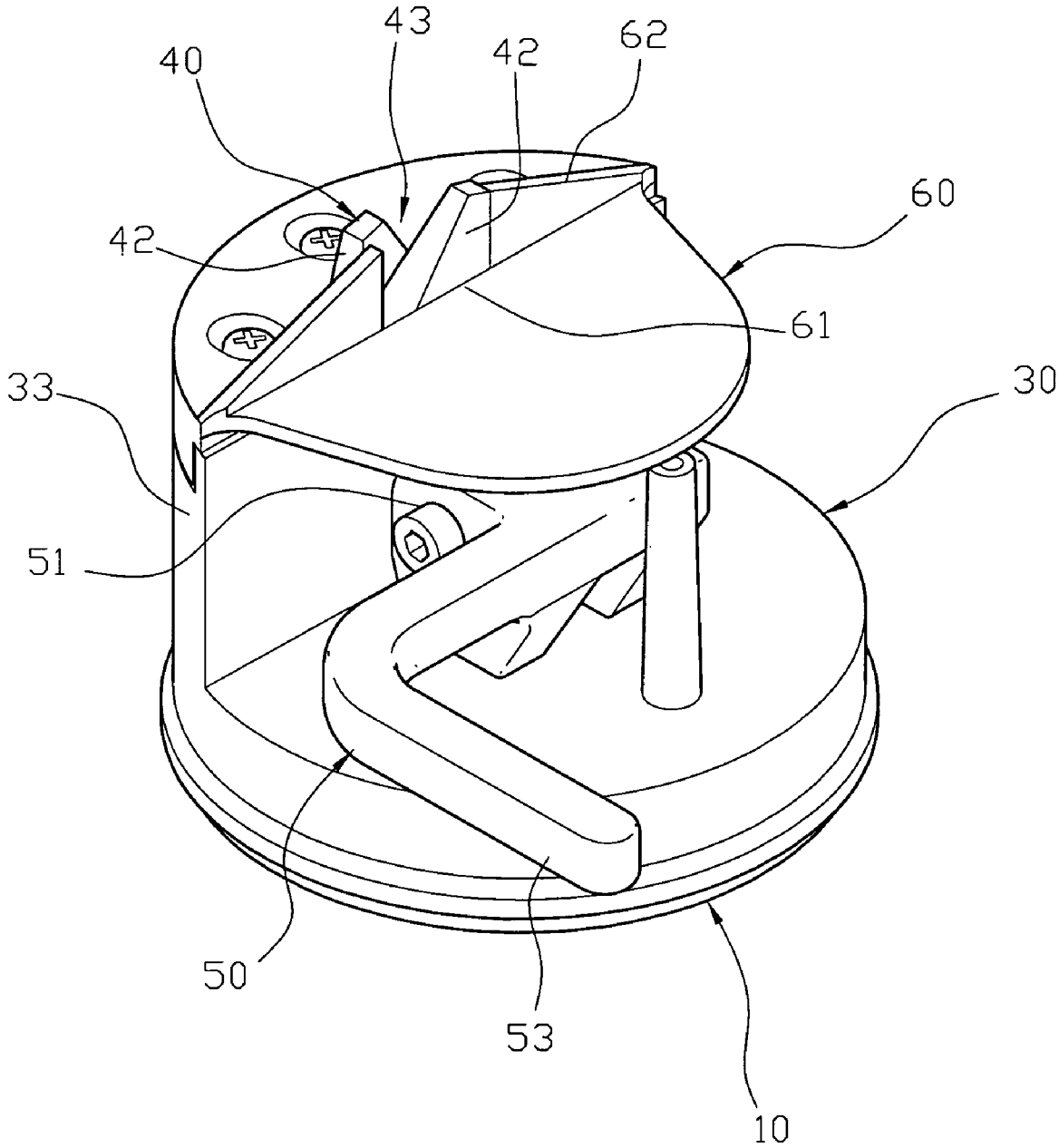
FIG. 1 is a perspective view of a blade grinding tool in accordance with the preferred embodiment of the present invention.
Figure 2:
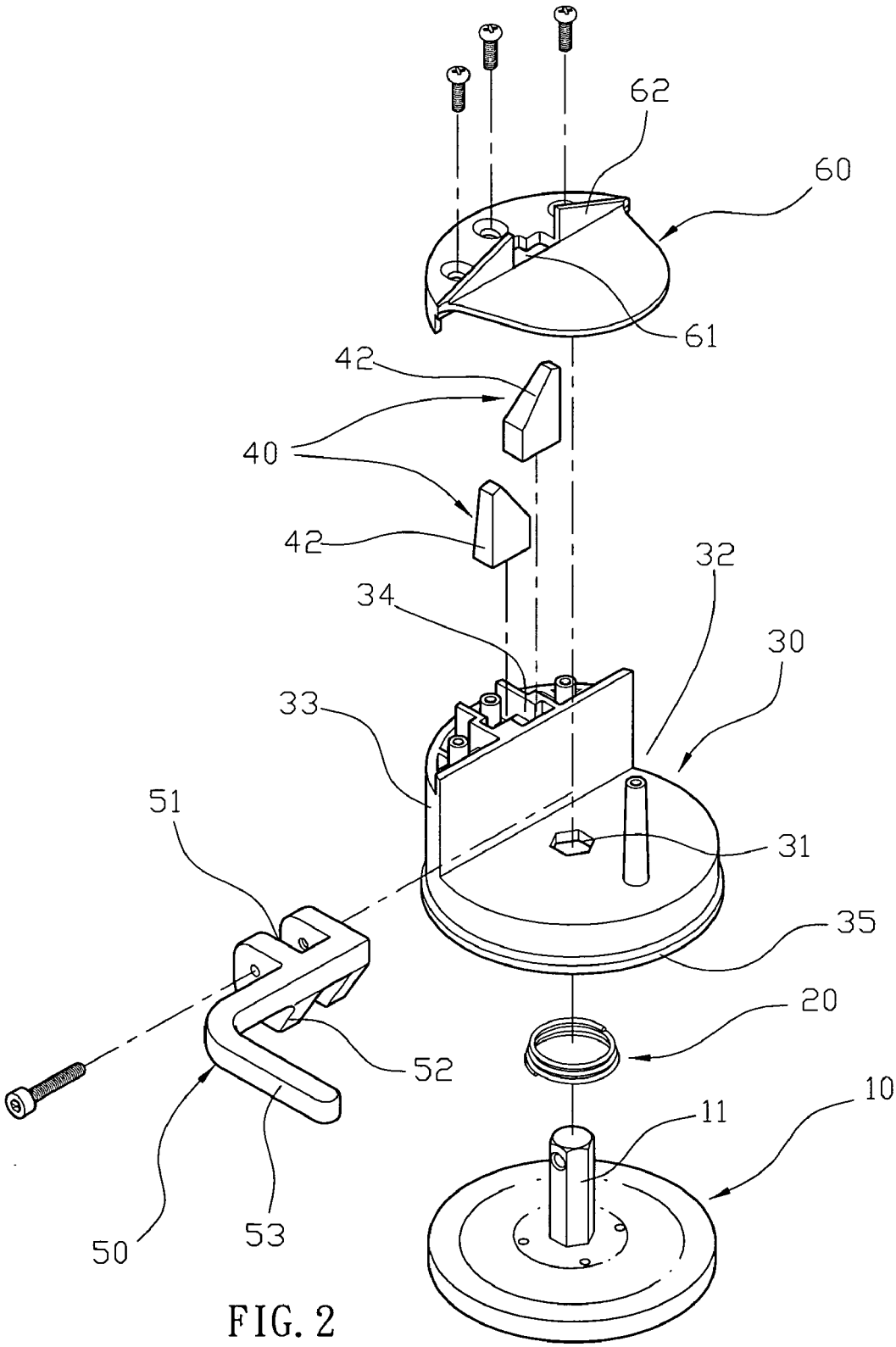
FIG. 2 is an exploded perspective view of the blade grinding tool as shown in FIG. 1.
Figure 3:
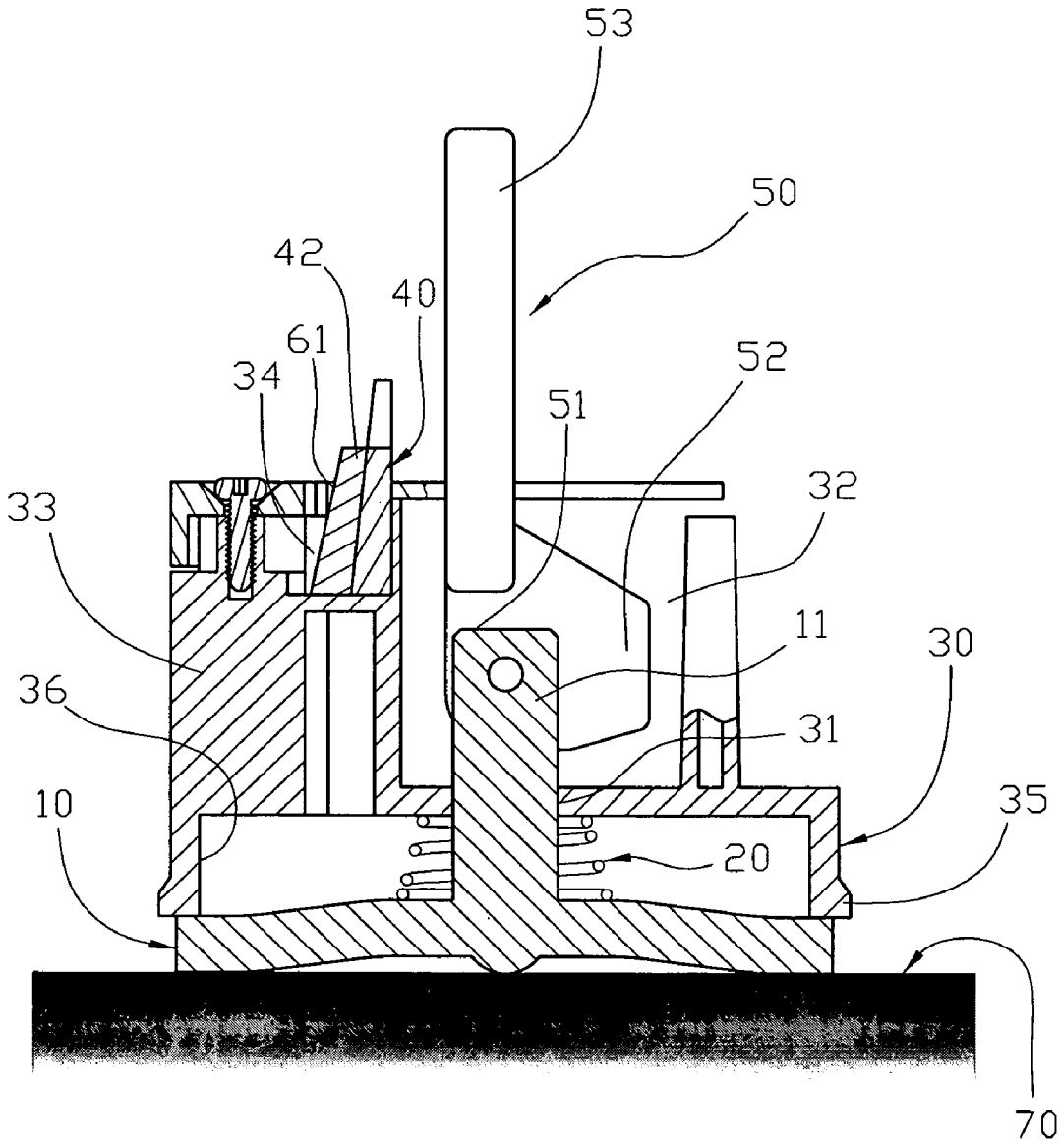
FIG. 3 is a plan cross-sectional view of the blade grinding tool as shown in FIG. 1.

Referring to the drawings and initially to FIGS. 1–3, a blade grinding tool in accordance with the preferred embodiment of the present invention comprises a main base 30, a sucker 10 mounted on the main base 30 and attached to a surface 70, and a grinding unit 40 mounted on the main base 30 for grinding and finishing a blade 74 (see FIG. 5) of a cutting tool 72, such as a knife or the like.

The main base 30 has a substantially L-shaped profile. The main base 30 has a first side and a second side and has an opening 32 defined between the first side and the second side thereof. The first side of the main base 30 has a surface formed with a substantially hexagonal through hole 31 communicating with the opening 32 of the main base 30. The first side of the main base 30 has a periphery formed with an outwardly extended press edge 35 rested on a periphery of the sucker 10. The first side of the main base 30 has an inside formed with a receiving space 36 to receive the sucker 10. The second side of the main base 30 is perpendicular to the first side of the main base 30 and provided with a mounting seat 33 having an inside formed with an insertion hole 34.

The sucker 10 has a suction force and has a surface provided with a substantially hexagonal pull lever 11 extended through the through hole 31 of the main base 30 into the opening 32 of the main base 30. The pull lever 11 of the sucker 10 is movably mounted in the through hole 31 of the main base 30, and an elastic member 20 is mounted on the pull lever 11 of the sucker 10 and pressed between the main base 30 and the sucker 10.

Figure 4:
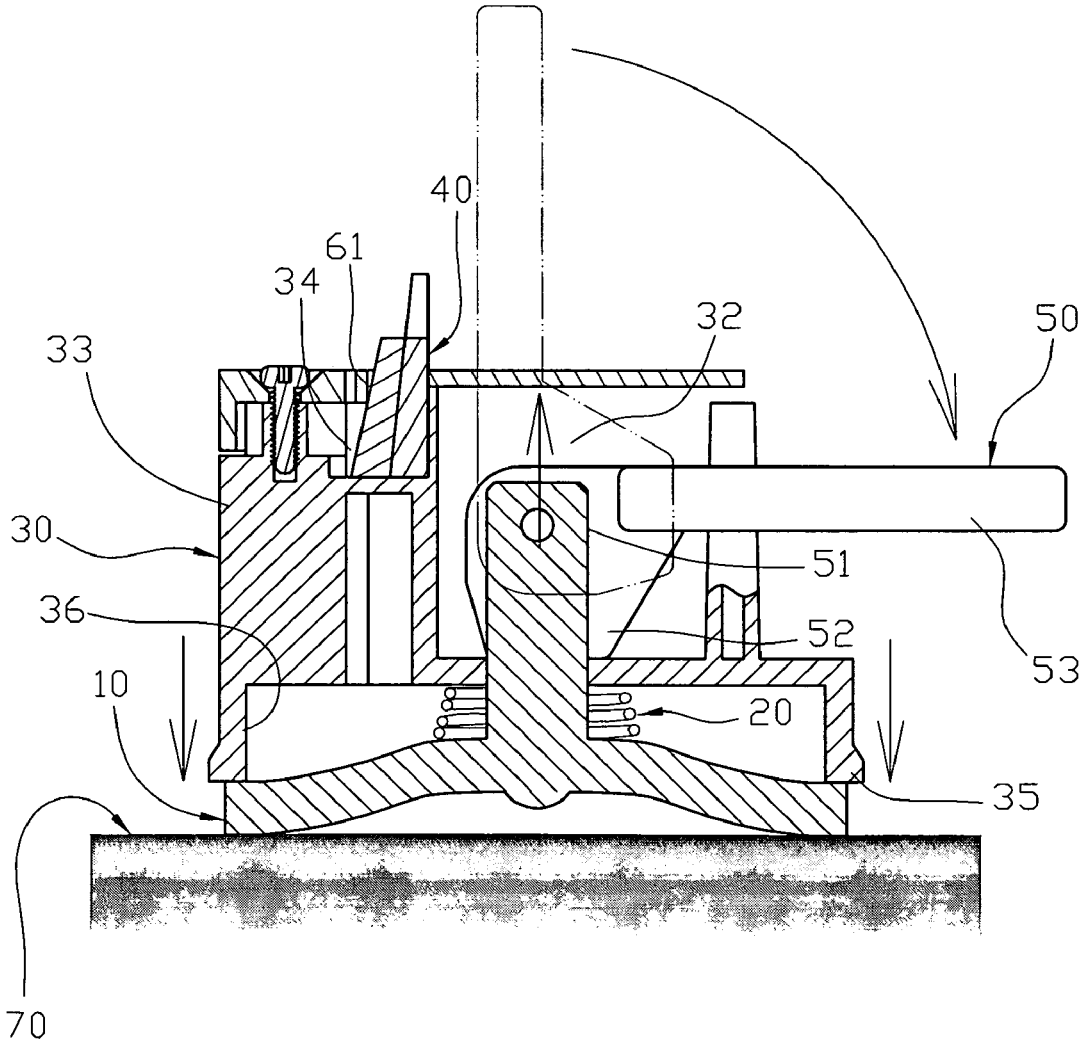
FIG. 4 is a schematic operational view of the blade grinding tool as shown in FIG. 3.

A control handle 50 is mounted on the sucker 10 and secured to the main base 30 to control movement of the sucker 10. The control handle 50 is pivotally mounted in the opening 32 of the main base 30 and has a first portion formed with a pivot seat 51 pivotally mounted on the pull lever 11 of the sucker 10 and a second portion formed with a handlebar 53. The pivot seat 51 of the control handle 50 has a side formed with an eccentrically arranged press block 52 that is movable between a first position as shown in FIG. 3 where the press block 52 is spaced from the main base 30 to release the sucker 10 and a second position as shown in FIG. 4 where the press block 52 is urged on the main base 30 to lift the pull lever 11 of the sucker 10 so as to compress the sucker 10 by the press edge 35 of the main base 30.

The grinding unit 40 is mounted on the mounting seat 33 of the main base 30 and includes two laminating tapered grindstones 42 inserted into the insertion hole 34 of the mounting seat 33. The two grindstones 42 of the grinding unit 40 are juxtaposed to each other to form a grinding space 43 to receive the blade 74 of the cutting tool 72.

A cover 60 is mounted on the mounting seat 33 of the main base 30 to cover the opening 32 of the main base 30. The cover 60 has an inside formed with a passage 61 to allow passage of the grinding unit 40 which is exposed outwardly from the passage 61 of the cover 60. The passage 61 of the cover 60 is provided with two opposite limit plates 62 rested on the grinding unit 40 to limit movement of the grinding unit 40.

As shown in FIG. 3, the press block 52 is spaced from the main base 30 to release the sucker 10.

As shown in FIG. 4, when the control handle 50 is pivoted on the pull lever 11 of the sucker 10, the press block 52 is moved to press the main base 30 to lift the pull lever 11 of the sucker 10 so as to compress the sucker 10 by the press edge 35 of the main base 30 to attach the sucker 10 to the surface 70 so that the sucker 10 is bonded onto the surface 70 closely and exactly.

Figure 5:
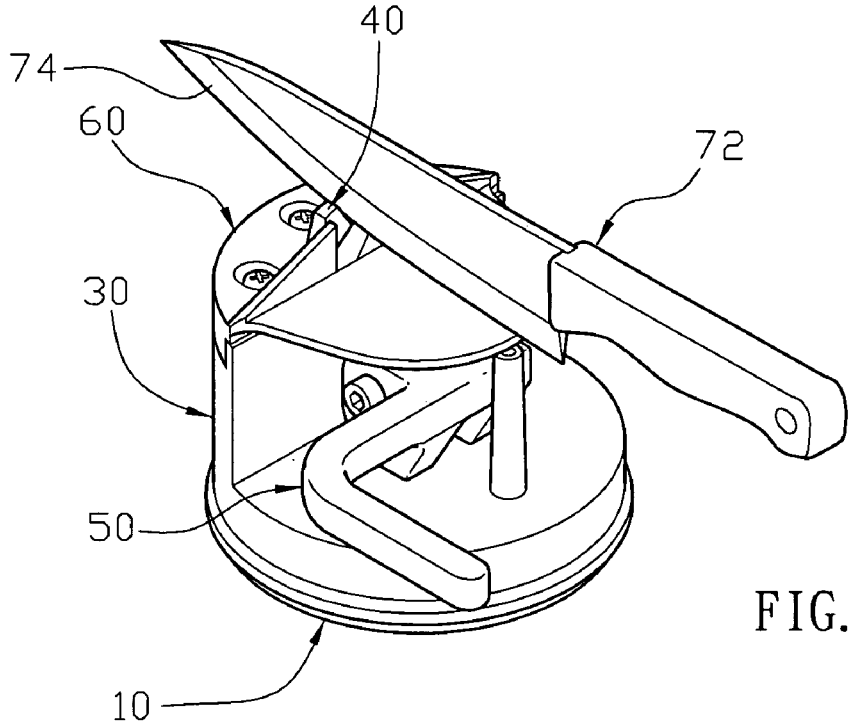
FIG. 5 is a schematic operational view of the blade grinding tool as shown in FIG. 1.

As shown in FIG. 5, the sucker 10 is attached to a horizontal surface (not shown), so that the blade 74 of the cutting tool 72 is grinded by the grinding unit 40 in a horizontal manner.

Figure 6:
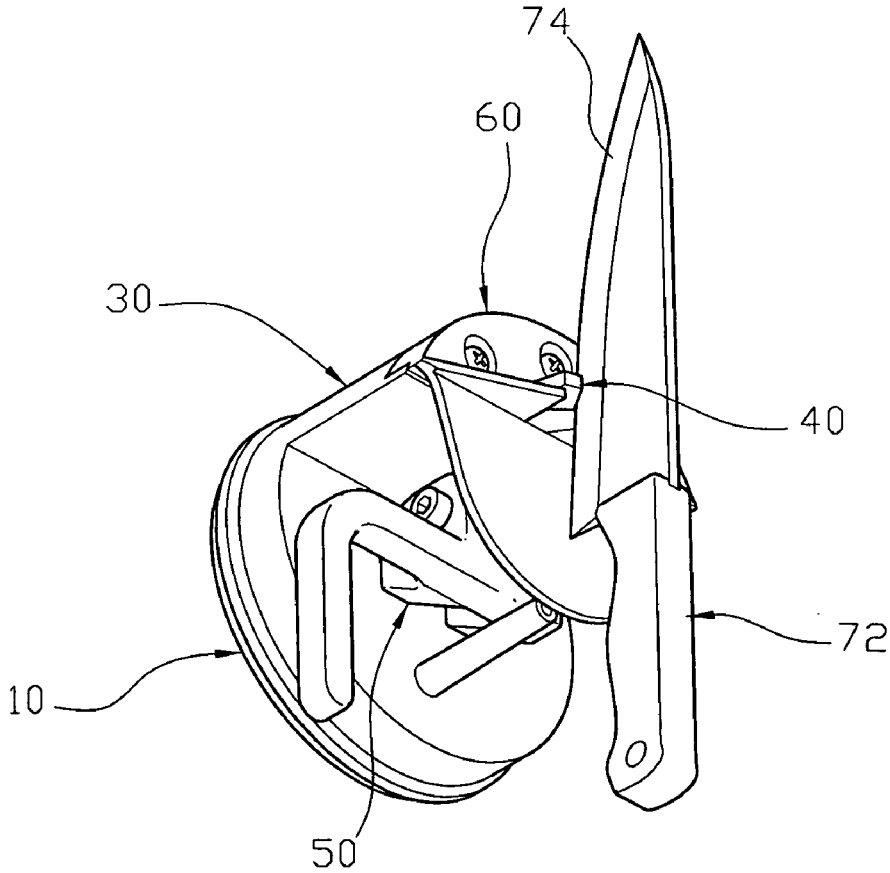
FIG. 6 is a schematic operational view of the blade grinding tool as shown in FIG. 1.

As shown in FIG. 6, the sucker 10 is attached to a vertical surface (not shown), so that the blade 74 of the cutting tool 72 is grinded by the grinding unit 40 in a vertical manner.

Accordingly, the blade grinding tool is attached to a surface, so that a user needs not to hold the blade grinding tool by his one hand when grinding the blade 74 of the cutting tool 72 by the grinding unit 40, thereby facilitating the user grinding the blade 74 of the cutting tool 72, and thereby protecting the user's safety. In addition, the blade grinding tool is attached to a horizontal surface and a vertical surface so that the blade grinding tool is operated and stored easily, thereby facilitating the user operating the blade grinding tool, and thereby saving the space of storage of the blade grinding tool.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A blade grinding tool, comprising:

a main base;

a sucker mounted on the main base and attached to a surface;

a grinding unit mounted on the main base for grinding a blade of a cutting tool;

the main base having a first side and a second side and having an opening defined between the first side and the second side thereof;

the first side of the main base having a periphery formed with an outwardly extended press edge rested on a periphery of the sucker;

the first side of the main base having an inside formed with a receiving space to receive the sucker;

a control handle mounted on the sucker and secured to the main base to control movement of the sucker;

the first side of the main base having a surface formed with a through hole communicating with the opening of the main base, the sucker having a surface provided with a pull lever extended through the through hole of the main base into the opening of the main base, and the control handle having a first portion formed with a pivot seat pivotally mounted on the pull lever of the sucker and having a side formed with an eccentrically arranged press block that is movable to press the main base;

an elastic member mounted on the pull lever of the sucker and pressed between the main base and the sucker;

the control handle having a second portion formed with a handlebar;

the second side of the main base being provided with a mounting seat having an inside formed with an insertion hole, and the grinding unit being mounted on the mounting seat of the main base and including two laminating tapered grindstones inserted into the insertion hole of the mounting seat;

the sucker being selectively attached to a horizontal surface and a vertical surface;

the pull lever of the sucker being movably mounted in the through hole of the main base;

the control handle being pivotally mounted in the opening of the main base;

the through hole of the main base having a substantially hexagonal shape, and the pull lever of the sucker having a substantially hexagonal shape;

the main base having a substantially L-shaped profile;

the second side of the main base being perpendicular to the first side of the main base.

2. The blade grinding tool in accordance with claim 1, wherein the two grindstones of the grinding unit are juxtaposed to each other and are arranged in a staggered manner to form a grinding space to receive the blade of the cutting tool.

3. The blade grinding tool in accordance with claim 1, further comprising a cover mounted on the mounting seat of the main base to cover the opening of the main base.

4. The blade grinding tool in accordance with claim 3, wherein the cover has an inside formed with a step-shaped passage to receive and allow passage of the two grindstones of the grinding unit which is exposed outwardly from the passage of the cover.

5. The blade grinding tool in accordance with claim 4, wherein the passage of the cover is provided with two opposite limit plates rested on the grinding unit to limit movement of the grinding unit.

6. The blade grinding tool in accordance with claim 1, wherein the press block is movable between a first position where the press block is spaced from the main base to release the sucker and a second position where the press block is urged on the main base to lift the pull lever of the sucker so as to compress the sucker.

* * * * *